US006398306B1

(12) United States Patent
Mack

(10) Patent No.: US 6,398,306 B1
(45) Date of Patent: Jun. 4, 2002

(54) SEAT CUSHION ADJUSTMENT APPARATUS

(76) Inventor: Chieko Mack, P.O. Box 534, Aberdeen, WA (US) 98520

( * ) Notice: Subject to any disclaimer, the term of this patent is extended or adjusted under 35 U.S.C. 154(b) by 0 days.

(21) Appl. No.: 09/490,338

(22) Filed: Jan. 24, 2000

(51) Int. Cl.[7] ..... A47C 3/025
(52) U.S. Cl. ..... 297/337; 297/284.11
(58) Field of Search ..... 297/337, 311, 297/284.11, 284.1

(56) References Cited

U.S. PATENT DOCUMENTS

| | | | | | |
|---|---|---|---|---|---|
| 2,257,103 | A | | 9/1941 | Brokerin | |
| 3,007,738 | A | | 11/1961 | Gardel | |
| 5,171,062 | A | | 12/1992 | Courtois | |
| 5,553,920 | A | | 9/1996 | Meschkat | |
| 5,755,488 | A | * | 5/1998 | Beda et al. | 297/337 |
| 5,947,559 | A | * | 9/1999 | Williams | 297/337 |
| 6,027,168 | A | * | 2/2000 | Crossman et al. | 297/337 |
| 6,099,076 | A | * | 8/2000 | Nagel et al. | 297/337 |
| 6,135,556 | A | * | 10/2000 | Chu et al. | 297/337 |
| 6,203,107 | B1 | * | 3/2001 | Jonsson | 297/337 |

FOREIGN PATENT DOCUMENTS

| | | | | |
|---|---|---|---|---|
| DE | 220331 | * | 8/1961 | 297/337 |
| DE | 1529497 | * | 4/1970 | 297/337 |

* cited by examiner

*Primary Examiner*—Milton Nelson, Jr.
(74) *Attorney, Agent, or Firm*—Brian J. Coyne

(57) ABSTRACT

Apparatus for use in an easy chair for manual fore and aft, longitudinal adjustments of the seat cushion. A flexible seat cushion rests upon a carriage assembly. The carriage assembly has a pair of straight, laterally spaced-apart, fixed tracks and, longitudinally coplanar therewith, a pair of pliable tracks that extend rearwardly from the fixed tracks. The fixed and pliable tracks are received by, and slidably engage, a pair of laterally spaced-apart channels mounted between vertical frame supports of the chair. The channels extend rearwardly from a front portion of the chair, behind and downwardly from the back of the chair. When fully retracted, the carriage assembly and seat cushion likewise extend partially behind and down from the back of the chair. The carriage assembly can be locked in any one of a plurality of positions by manual manipulation of a handle attached to a bale. The bale is pivotally mounted to the carriage assembly such that up and down movements of the handle cause a pair of hook ends of the bale to move into and out of detents longitudinally disposed along and adjacent to the fixed tracks, thereby locking and unlocking the carriage assembly.

7 Claims, 13 Drawing Sheets

SEAT CUSHION ADJUSTMENT APPARATUS

BACKGROUND OF THE INVENTION

1. Field of the Invention

This invention relates to adjustable seats, and particularly to arm chairs having seat cushions that can be adjusted forward and aft to comfortably support persons of differing size and stature.

2. Background Art

Because of the need to accommodate persons of differing size and stature, adjustable seats have been developed and installed in a wide variety of seating environments, such as dentists' chairs, barbers' chairs, easy chairs, and motor vehicles. In the case of motor vehicles, adjustable seats have been either of the manually adjustable kind, or electrically powered. In the case of manually adjustable, front seats installed in motor vehicles, fore and aft adjustments of the seat cushion were performed by sliding the entire seat fore and aft along floor-mounted tracks; no provision was made for varying the front-to-rear dimensions of the seat cushions themselves. Electrically powered, adjustable front seats for motor vehicles typically permit a wider range of seat adjustments than manual versions. See, for instance, U.S. Pat. No. 5,553,920 to R. Meschkat et al.; and see especially U.S. Pat. No. 5,171,062 to B. Courtois, which disclosed an electrically powered adjustable front seat for a motor vehicle that permitted varying the front-to-rear dimension of the sitting portion of the seat.

Manually adjustable seating has distinct advantages over electrically powered adjustable seating for residential applications. Manual adjustment obviates the need for supplying electrical power to an adjustable easy chair, thereby permitting greater choice and flexibility in arranging furniture for a desired residential floor plan or interior decoration scheme. A manual adjustment mechanism, compared to an electrically powered adjustment mechanism, simplifies assembly and repair, reduces manufacturing cost, and lessens the weight of the chair. U.S. Pat. No. 3,007,738 to R. Gardel, et al., disclosed a manually adjustable chair that permitted varying the front-to-rear dimension of the sitting surface by providing a flexible extension leg rest that was fore-and-aft slidable on a pair of channel-shaped tracks. The tracks extended rearwardly and upwardly along the sides of the chair back, such that, when the leg rest was moved aft to a retracted position, it would slide up inside a hollow space within the chair back. For an easy chair, however, this arrangement is unsatisfactory because the relatively large and thick seat cushion of an easy chair would require an excessively large and bulky hollow space within the chair back. Moreover, it requires more upper body strength than some elderly or infirm persons can muster to be able to force an object as large and heavy as a seat cushion up inside a seat back.

There remains a need, therefore, for a manual seat cushion adjustment apparatus for an easy chair that permits fore-and-aft adjustment of the seat cushion to accommodate persons of differing size and stature. This need is fulfilled by the present invention.

SUMMARY OF THE INVENTION

A manual seat cushion adjustment apparatus is provided for a chair equipped with a pair of spaced-apart, vertical frame supports, a seat back laterally disposed between, and extending above, rear portions of the frame supports, and a flexible seat cushion. The apparatus permits fore and aft movements of the seat cushion, thereby varying the front-to-rear dimension of the sitting portion of the chair to comfortably accommodate persons of differing size and stature. The flexible cushion rests upon a carriage assembly. The carriage assembly is laterally disposed between the frame supports and is longitudinally movable, fore and aft, between a first, extended position and a second, retracted position. A carriage assembly support means is laterally disposed between, and attached to, the frame supports, for supporting the carriage assembly and permitting longitudinal movements thereof. Manual means is attached to the carriage assembly support means for reversibly locking the carriage assembly in any one of a plurality of longitudinally spaced-apart positions.

In a preferred embodiment, the carriage assembly includes a pair of horizontal, longitudinally-extended, laterally spaced-apart side rails. A carriage base extends between, and joins, the side rails. A straight, longitudinally-extended, fixed track is attached to, and extends along an entire lower surface of each of the side rails. A pliable track is aligned and continuous with each fixed track and extends rearwardly and downwardly thereof. A plurality of transversely elongated, rectangular slats extend laterally between, and are attached to, the pliable tracks. A laterally-disposed header joins front portions of the side rails. The carriage assembly support means includes a horizontal, rectangular support panel disposed between, and joining, the frame supports. A pair of longitudinally-extended, laterally spaced-apart channels are mounted on an upper surface of the support panel. The channels are adapted to receive and retain the fixed and pliable tracks in sliding engagement. Each of the channels has a rear portion that extends rearwardly and downwardly from the support panel for receiving and retaining the pliable tracks in sliding engagement. Each of the channels has a U-shaped lateral cross-section, and each of the fixed and pliable tracks has an I-shaped, lateral cross section.

The pliable tracks can be fabricated from some suitably pliable material. In a preferred embodiment, however, pliability is provided by incorporating into each pliable track a series of alternating upper and lower links, hingedly connected to each other so as to permit vertical rotation of each link with respect to adjacent links. Each upper link has a first, laterally-disposed downturned, rolled edge, and a second, oppositely-directed, laterally-disposed, downturned, rolled edge. Each lower link has a first and second upturned, rolled edges that partially surround the downturned edges of adjacent upper links. A hinge pin is inserted through each of the first and second rolled edges of the upper links.

The manual means for locking the carriage assembly preferably includes a bale having a pair of laterally spaced-apart, longitudinally-directed stringers joined at a forward end thereof by a laterally disposed bight portion. The bale is preferably formed by bending metal rod or wire. Each of the stringers has a straight, front portion, disposed adjacent a side rail, and a straight rear portion that is vertically displaced with respect to the front portion. Each of the rear portions of the bale stringers terminate in an upturned hook end. A pivot arm joins the front portion to the rear portion of each stringer, and maintains the vertical displacement between them. Means attached to the side rails are provided for pivoting the pivot arm about a horizontal, lateral axis. A handle extends forwardly from the bight portion of the bale through an opening in the header. A spring is disposed adjacent the opening in the header for urging the bight portion of the bale downward, thereby urging the hook ends upward. Detent means are attached to the support panel for receiving and retaining the upturned hook ends of the bail in any of a plurality of longitudinally-separated positions. Vertical displacement of the handle withdraws the hook ends from the detent means, which permit fore and aft movements of the carriage assembly and seat cushions. Once the seat cushion is in a new, desired position, the handle is released, whereby the hook ends insert into the detent means at a new location therein, locking the carriage assembly and seat cushion in place. An opening is provided between a lower portion of the seat back and the back of the chair in order to permit free fore and aft movements of the carriage assembly and seat cushion.

DETAILED DESCRIPTION OF THE PREFERRED EMBODIMENT

Figure 1:
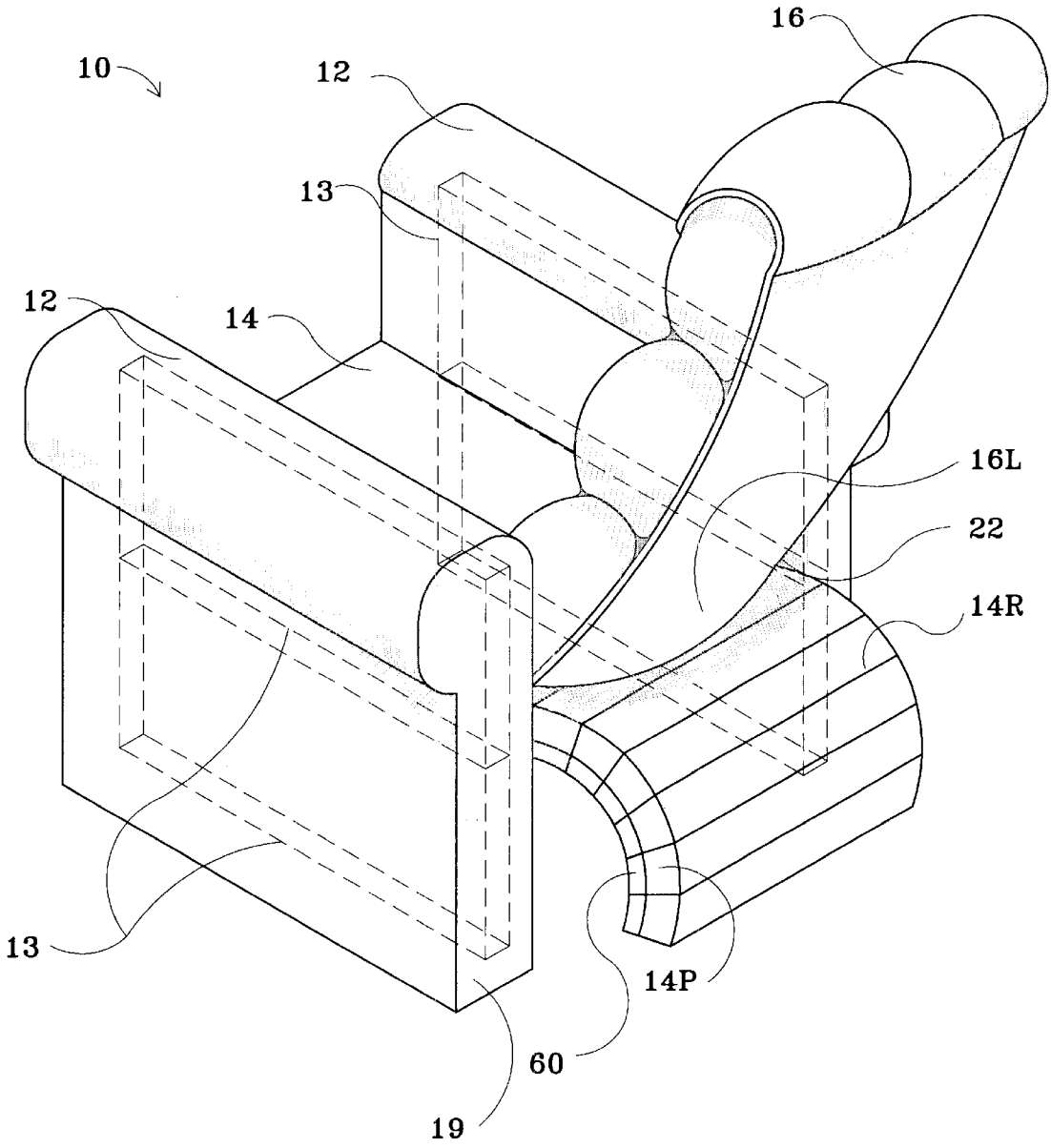
FIG. 1 is a rear perspective view of an easy chair that incorporates the invention, wherein the seat cushion and carriage assembly are fully retracted.
Figure 2:
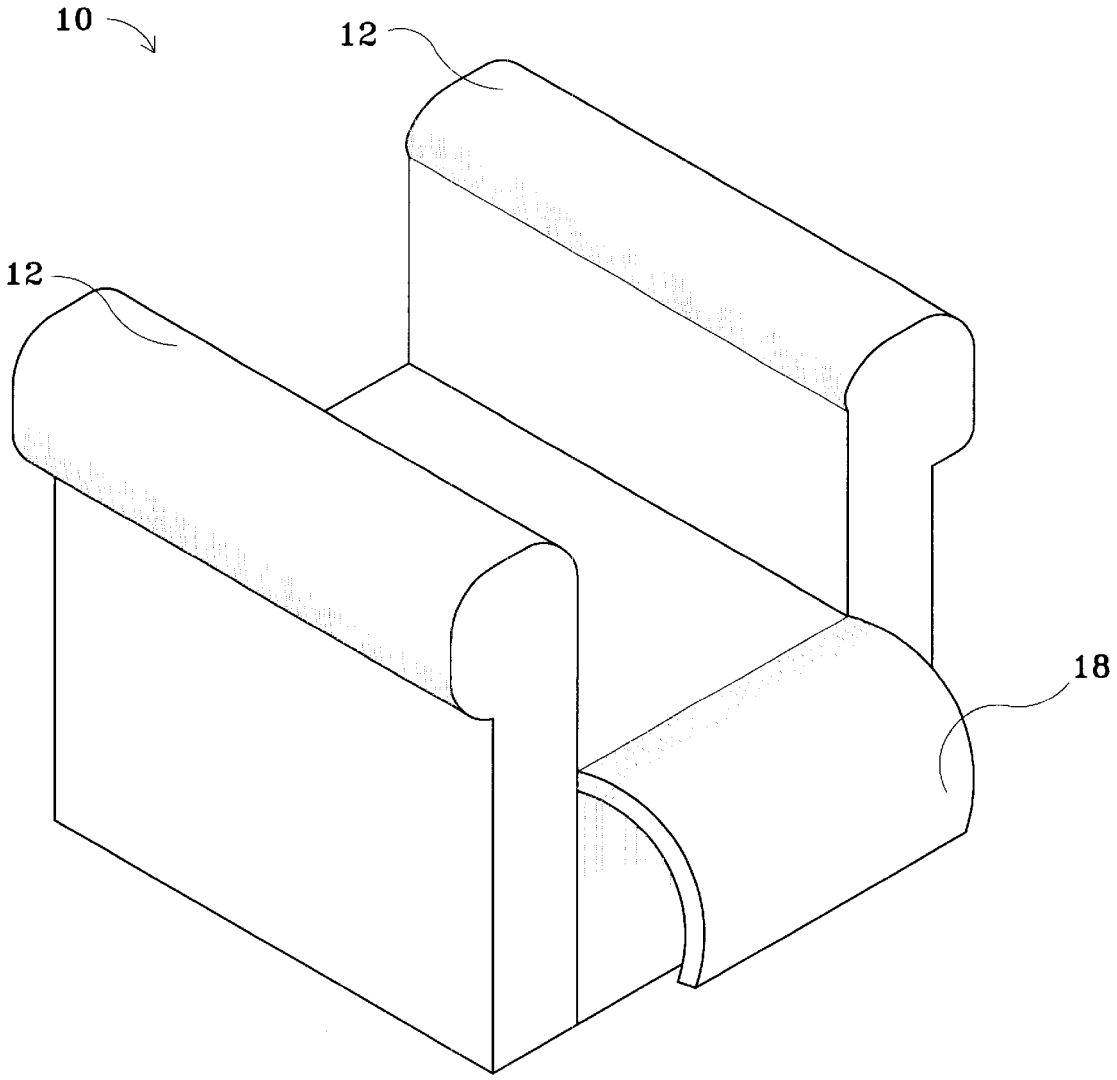
FIG. 2 is a rear perspective view of the chair with the seat back and seat cushion removed.
Figure 10:
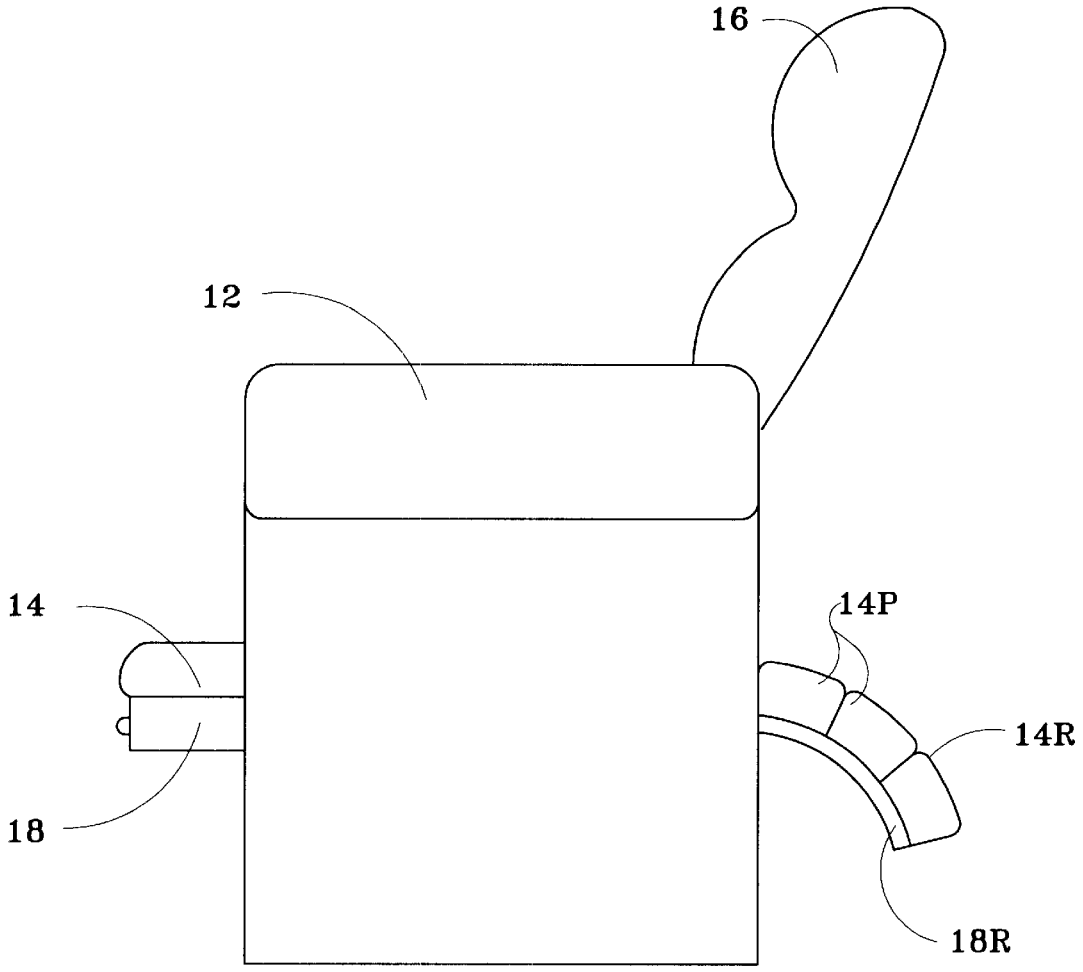
FIG. 10 is a side elevational view of the chair of FIG. 1 with the carriage assembly and seat cushion in forward extended position.

An easy chair 10, equipped with the apparatus of the present invention, is depicted in FIG. 1. The chair 10 is of generally conventional construction, and includes padded left and right arm rests 12 supported by a pair of vertical frame supports 13 (shown in phantom outline), a padded seat cushion 14, disposed between the frame supports 13, and a padded seat back 16 mounted to the chair over a rear portion 14R of the seat cushion 14. The seat cushion 14, together with the carriage assembly 18 upon which it rests, is movable between a retracted position (FIG. 1) and a forwardly extended position (FIG. 10). In the retracted position, the seat cushion 14 and the carriage assembly 18 extend behind the chair 10 through a slot opening 22 that extends from a lower edge 16L of the seat back 16 and to the chair back 19, such that the rear portion 14R of the seat cushion 14 angles rearwardly and downwardly. To facilitate bending in this manner, the cushion 14 is made of flexible materials and incorporates pleats 14P.

Figure 3:
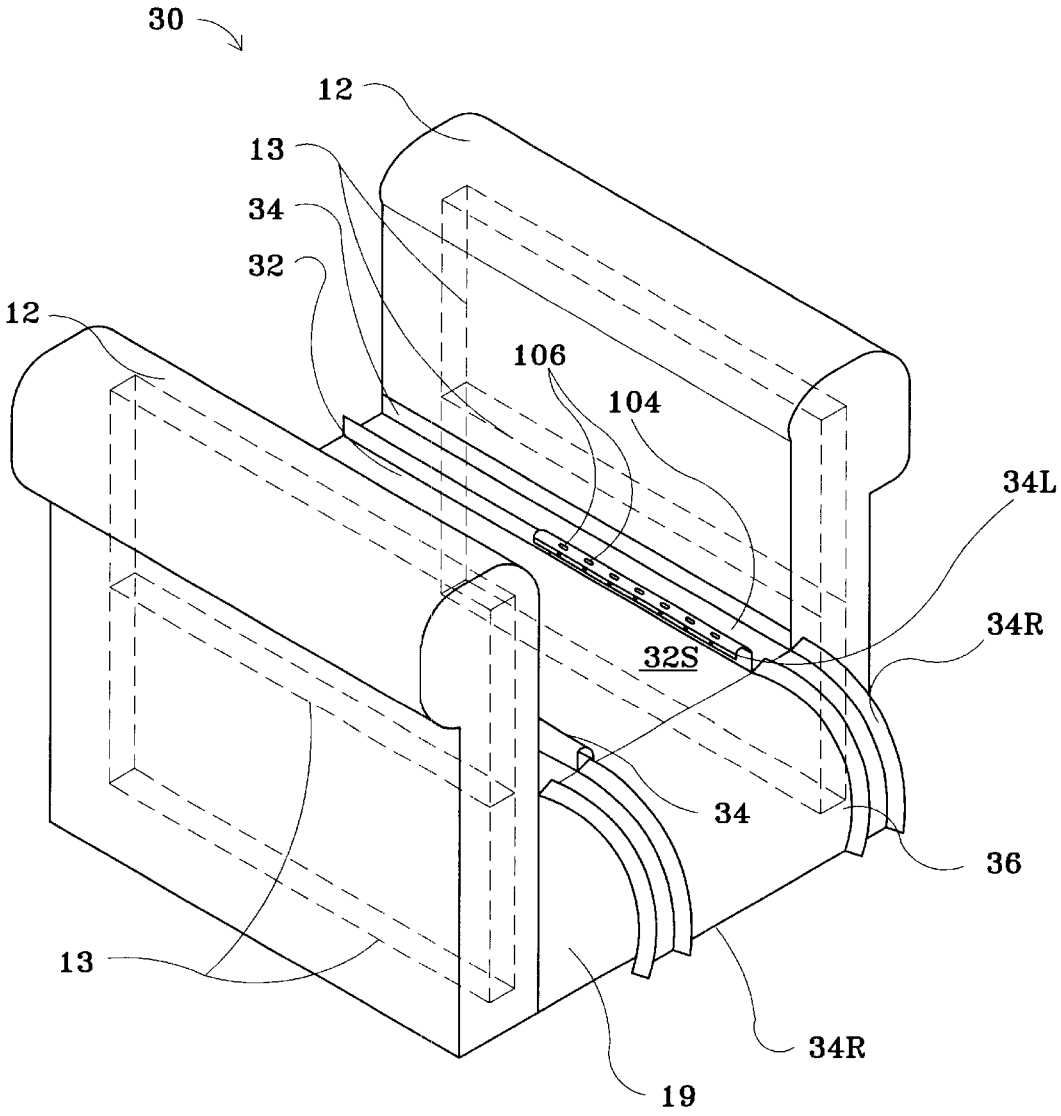
FIG. 3 is a rear perspective view of the chair with the carriage assembly removed.

A carriage assembly support means 30 is provided for mounting the carriage assembly 18 to the chair 10. As may be seen in FIG. 3, in a preferred embodiment, this includes a horizontal, rectangular support panel 32 disposed between, and joining the frame supports 13, and a pair of longitudinally extended, laterally spaced-apart channels 34 mounted on an upper surface 32S of the support panel 32. Each of the channels 34 has a rear portion 34R that extends behind the chair. The channels have a U-shaped lateral cross-section, and are open at the top. Preferably, the rear portions 34R are mounted, as shown in FIG. 3, on an upper surface of a substantially rectangular, cantilevered panel 36 that extends rearwardly and downwardly from the support panel 32.

Figure 4:
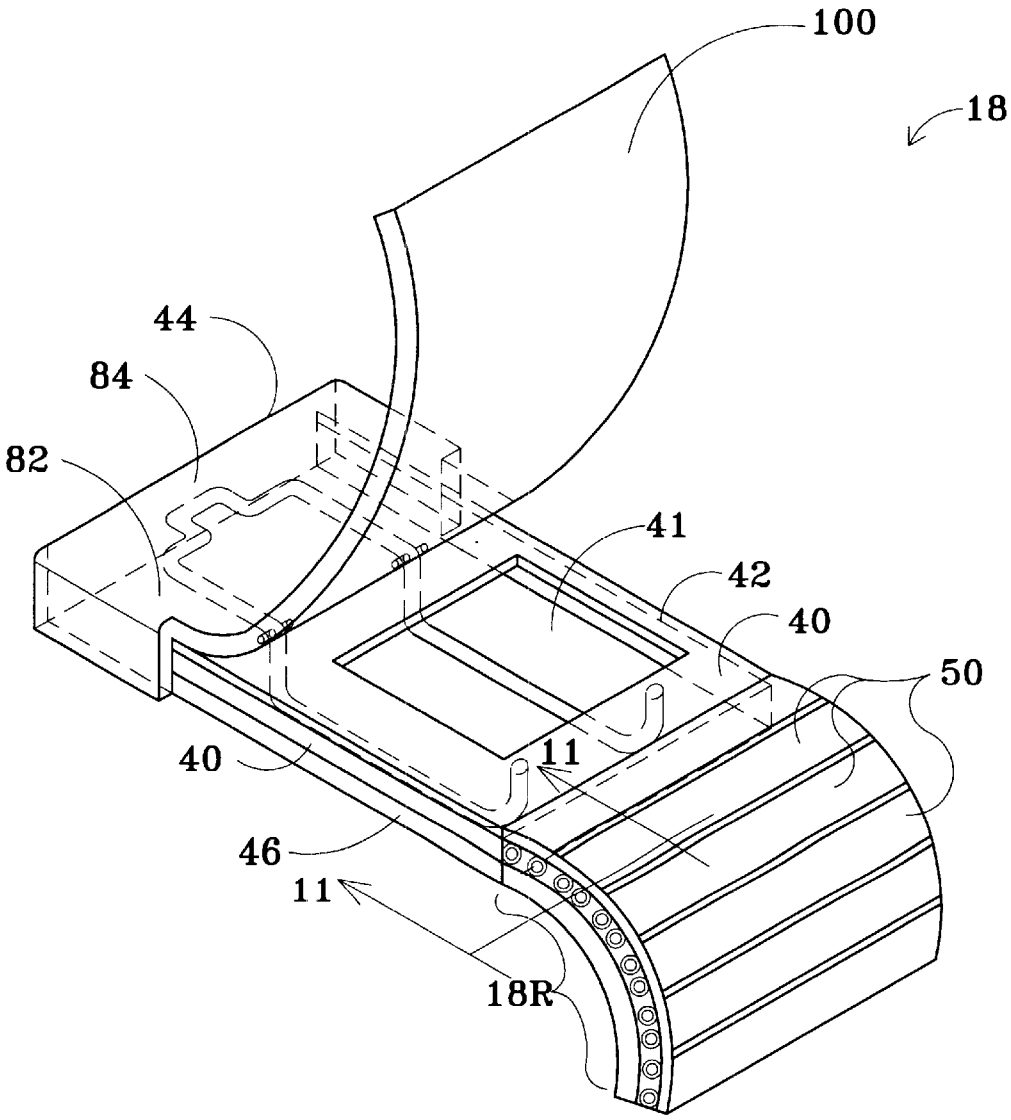
FIG. 4 is an upper rear, perspective view of the carriage assembly.
Figure 5:
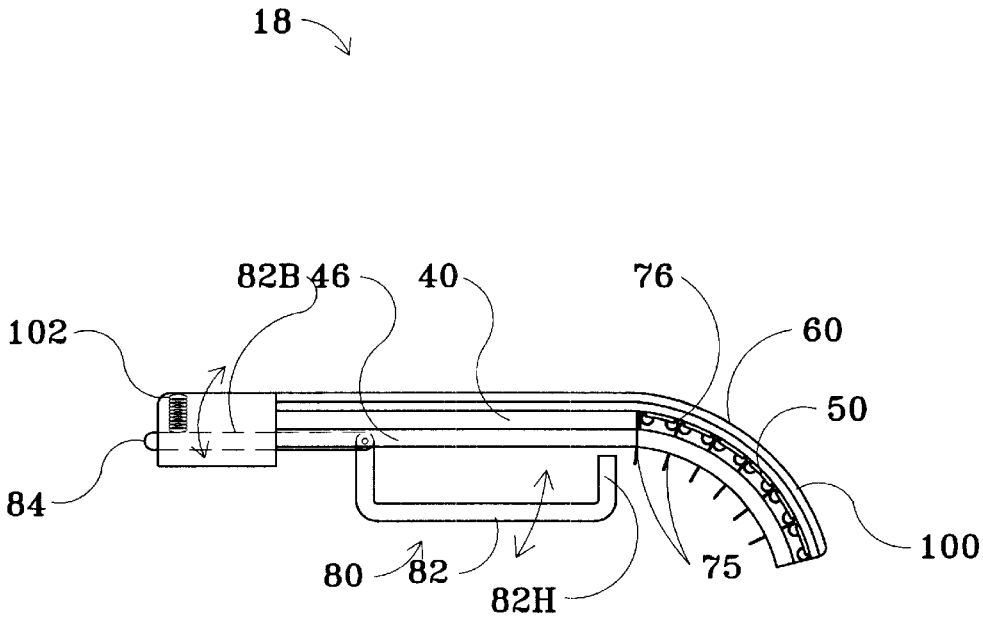
FIG. 5 is side elevational view of the carriage assembly.
Figure 6:
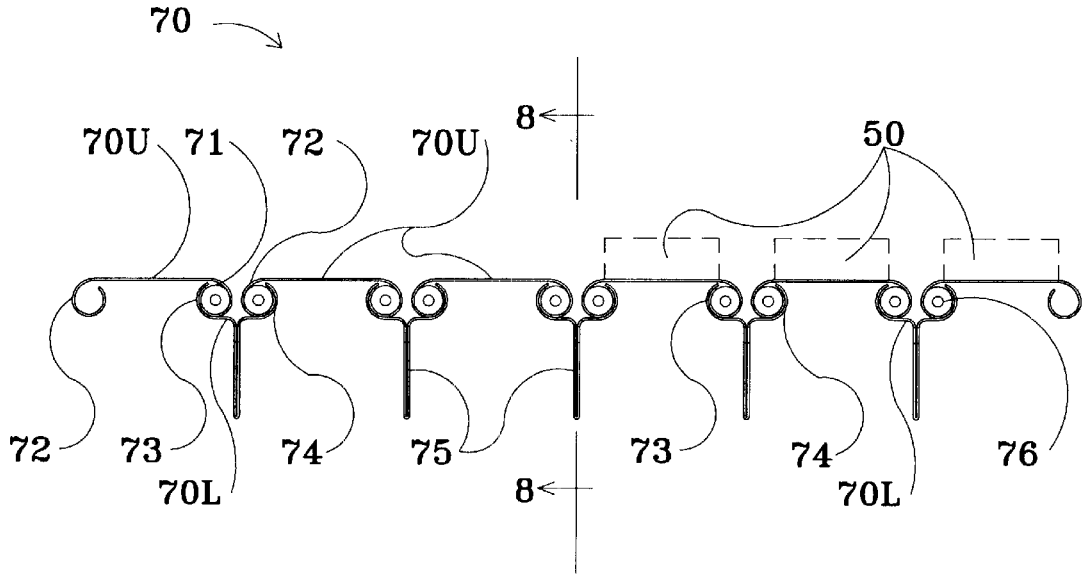
FIG. 6 is a side elevational view of hingedly connected panels of the pliable track within cutaway A of FIG. 4.
Figure 7:
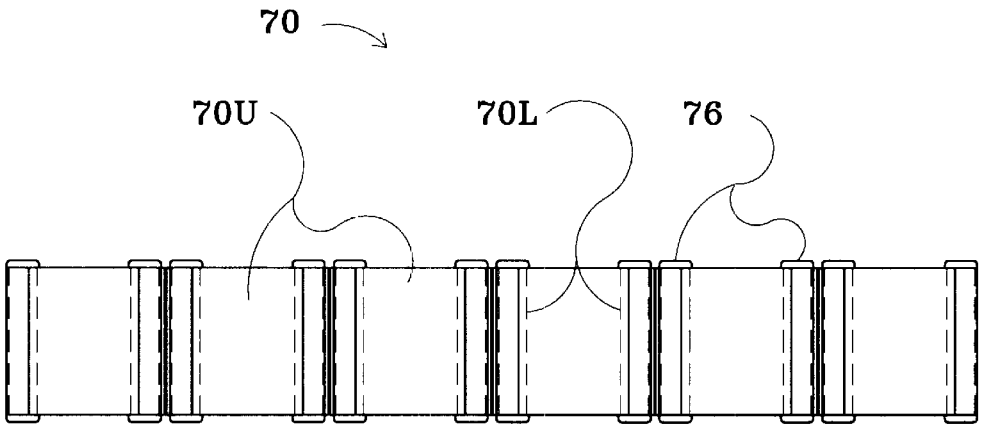
FIG. 7 is a top plan view thereof.
Figure 8:
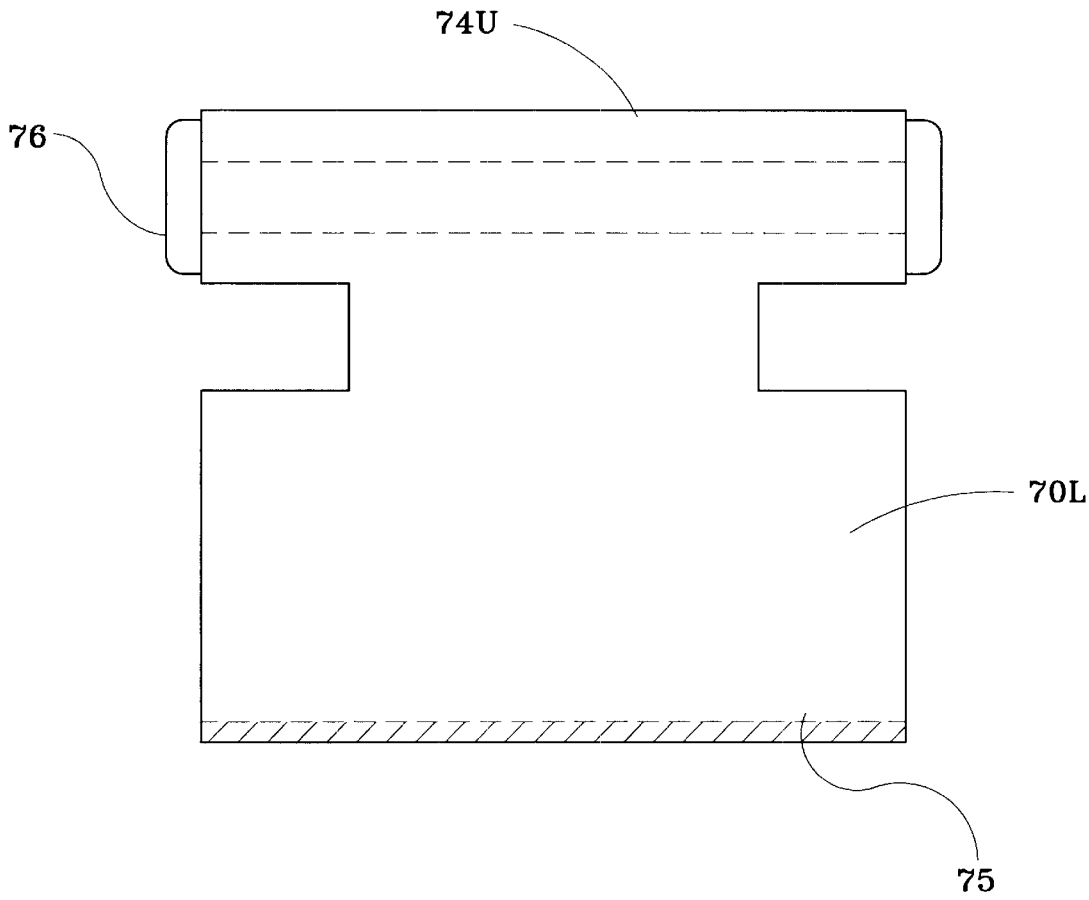
FIG. 8 is lateral, cross-sectional view taken along line 8—8 of FIG. 7.
Figure 9:
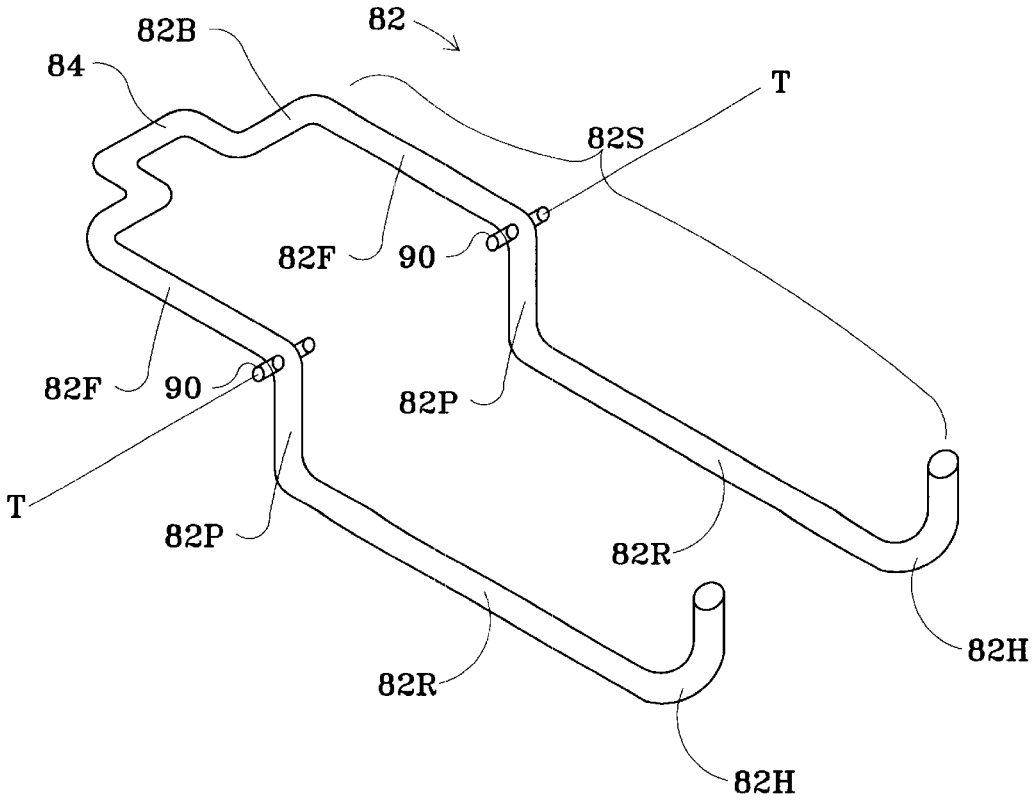
FIG. 9 is a rear perspective view of the bale of the invention.
Figure 11:
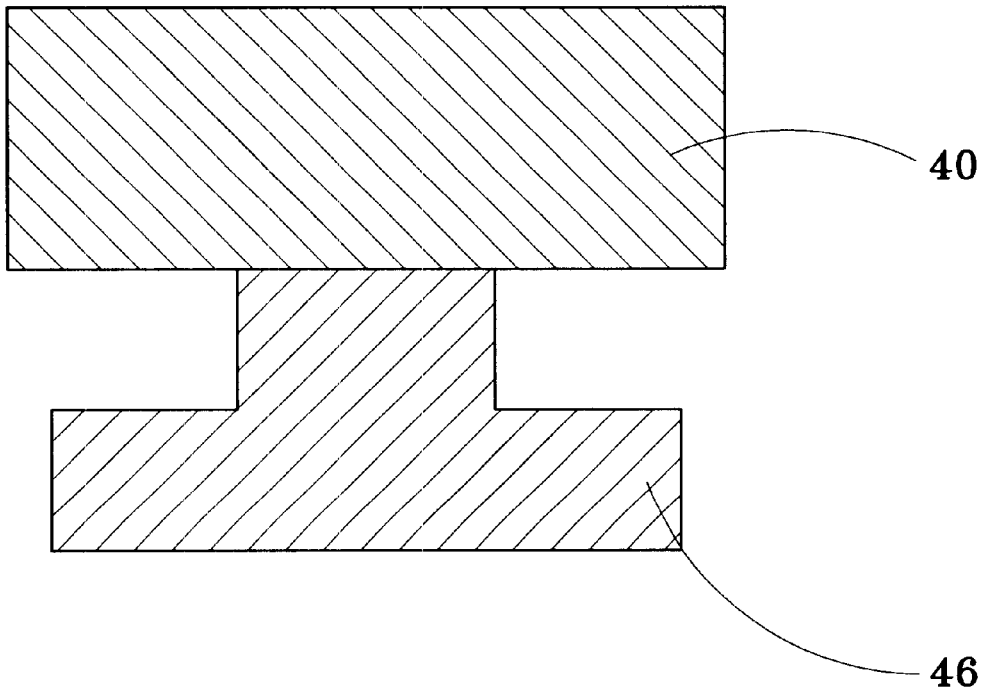
FIG. 11 is an enlarged, lateral cross-sectional view of a fixed track and rail.
Figure 12:
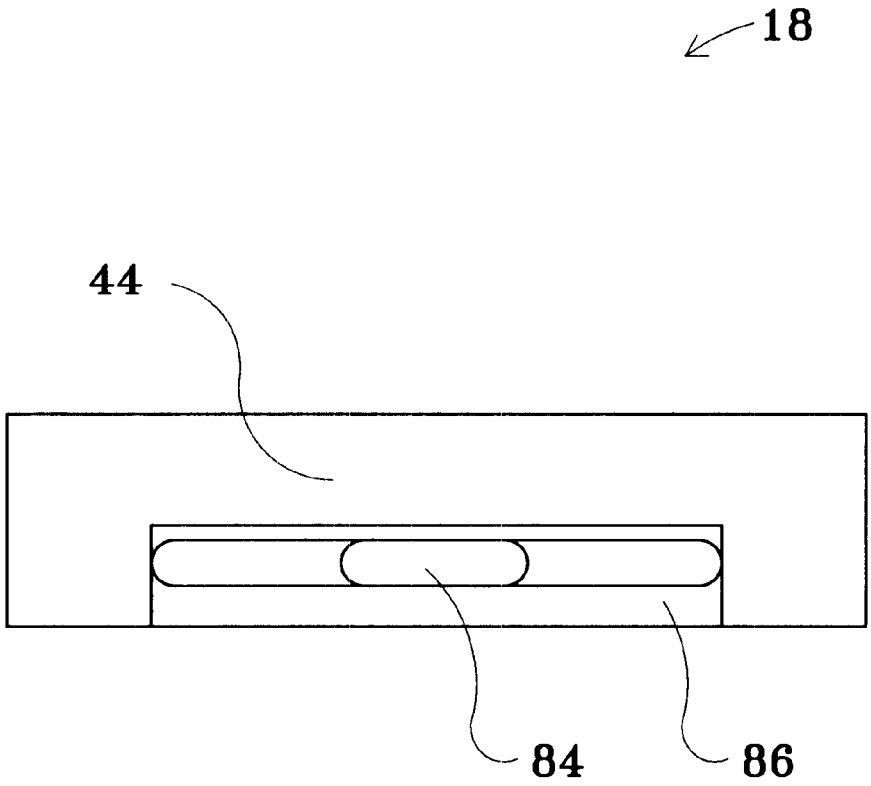
FIG. 12 is a front elevational view of the carriage assembly.
Figure 13:
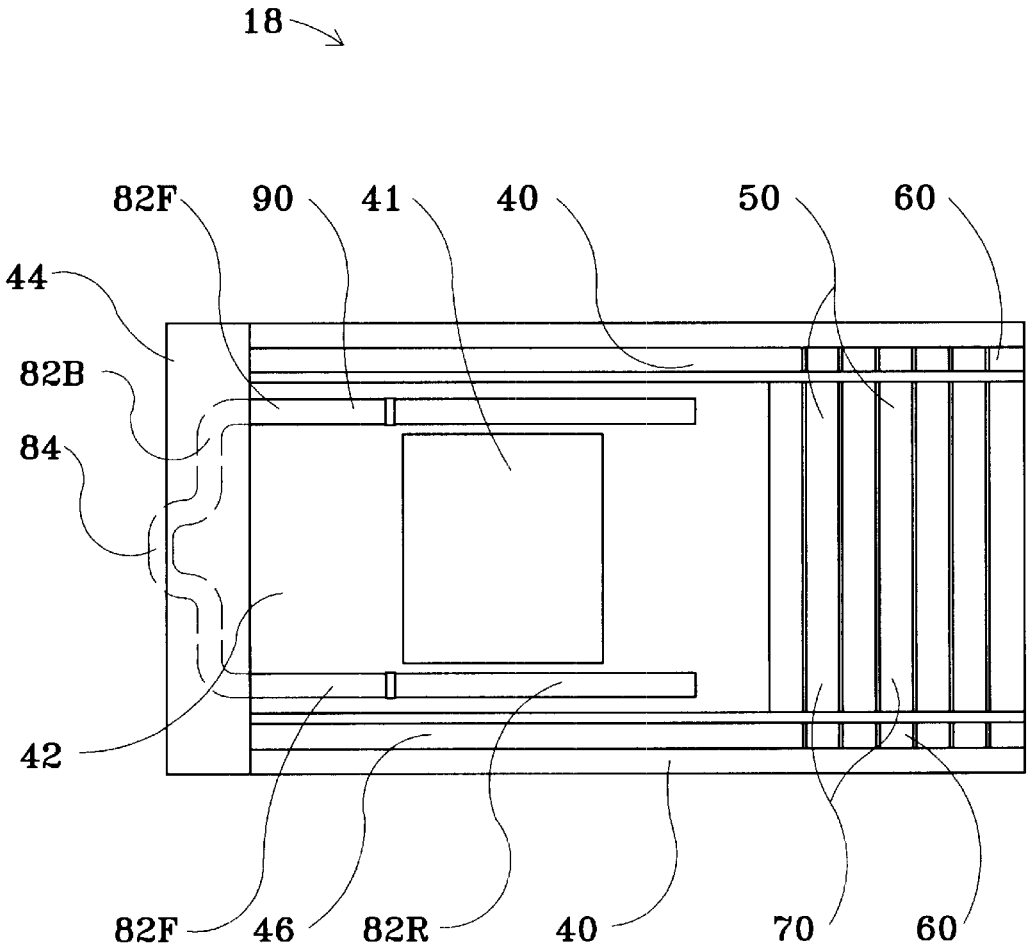
FIG. 13 is a bottom plan view of the carriage assembly.

Referring now to FIG. 4, it may be seen that the carriage assembly 18 includes a pair of horizontal, longitudinally-extended, laterally spaced-apart side rails 40 and a carriage base 42 in the form of a rectangular, flat panel, that extends between, and joins the side rails 40. The carriage base 42 preferably has a central, rectangular cutout 41. A laterally disposed header 44 joins front portions of the side rails 40. A straight, longitudinally-extended, fixed track 46 is attached to, and extends along an entire lower surface of each of the side rails 40. As may be seen in FIG. 11, each fixed track 46, in combination with an overlying rail 40, has an I-shaped lateral cross-section for retaining the fixed track 46 is sliding engagement with a channel 34. A pliable track 60 is aligned and continuous with each fixed track 46, and extends rearwardly and downwardly therefrom. Each pliable track 60 also has an I-shaped lateral cross-section for sliding engagement with a channel 34, as may be seen in FIG. 8. Extending rearwardly from the carriage base 42 is a plurality of transversely elongated, rectangular slats 50 that extend laterally between, and are attached to the pliable tracks 60. The slats 50, in combination with the pliable tracks 60, provide flexibility to the rear portion 18R of the carriage assembly 18.

Referring to FIGS. 5–8, each of the pliable tracks 60 preferably comprises a longitudinally disposed plurality of links 70 that are hingedly connected to each other so as to permit vertical rotation of each with respect to adjacent links 70. The links 70 are of two kinds: upper links 70U, which alternate with, and are hingedly attached to, lower links 70L. Each of the upper links 70U has a laterally disposed, downturned, first rolled edge 71, and an oppositely directed, laterally disposed, downturned, second rolled edge 72. Similarly, each of the lower links 70L has a laterally disposed, upturned, first rolled edge 73, and an oppositely directed, laterally disposed, upturned second rolled edge 74, rolled edges 73, 74 being slightly larger than, and surrounding, rolled edges 71, 72, respectively. Upper links 70U have flat upper surfaces, but lower links 70L have downward projections 75 adapted for retention within, and sliding engagement with, a channel 34. A hinge pin 76 is inserted through each of the first and second rolled edges 73, 74. The slats 50 are attached to upper surfaces of upper links 70U, as shown in phantom outline in FIG. 6.

Manual means 80 is attached to the carriage assembly support means 39 for reversibly locking the carriage assembly 18 in any one of a plurality of longitudinally spaced-apart positions. In a preferred embodiment, means 80 includes a bale 82 having a pair of laterally spaced-apart, longitudinally directed stingers 82S joined by a laterally disposed bight portion 82B. Each of the stringers has a straight, front portion 82F, disposed adjacent a side rail 40, a straight rear portion 82R that is vertically displaced with respect to the front portion 82F and that terminates in an upturned hook end 82H, and a pivot arm 82P joining the front portion 82F to the rear portion 82R. The bale 82 is pivotally suspended between the rails 40 by a pair of horizontal, oppositely directed pivot pins 90 attached to said rails 40 and inserted through apertures (not shown) in the pivot arms 82P. A handle 84 extends forwardly from the bight portion 82H within a cutout or opening 86 within the header 44. A spring 102 within the slot 86 is attached to bight portion 82B and urges the hook ends 82H into detent means 104. The detent means 104, as shown in FIG. 3, is a lip extension 34L on each of the channels 34 having a plurality of longitudinally separated recesses or apertures 106 for receiving the hook ends 82H from below. Whenever it is desired to reposition the seat cushion 14, the handle 84 is pulled up, thereby withdrawing the hook ends 82H from detent means 104 and unlocking the carriage assembly 18. The handle 84 is then pushed or pulled to readjust the fore/aft position of the seat cushion, and the handle is released to permit the hook ends to reinsert into detent means 104, thereby re-locking the carriage assembly in a new position.

A cover flap 100, comprising cloth or plastic sheet, is attached to, and covers the header 44, except for opening 86, and extends longitudinally over the entire length of the carriage assembly 18. The bale 82 can be formed by bending metal rod or wire, or can be rigid plastic. The channels 34, links 70 and hinge pins 71 are preferably metal, e.g., aluminum. The remainder of the apparatus can be made of wood, plastic or metal. Thus, an apparatus according to the concepts of the invention has been illustrated and described in sufficient detail to enable one of ordinary skill in the art to practice the invention. Since various modifications in detail, material and arrangements of parts are within the spirit of the invention herein disclosed and described, the scope of the invention should be limited solely by the scope of the claims.

I claim:

1. A seat cushion adjustment apparatus for use with a chair equipped with a pair of spaced-apart, vertical frame supports, a seat back laterally disposed between, and extending above, rear portions of said frame supports, and a flexible seat cushion, said apparatus comprising:

(a) a carriage assembly laterally disposable between said frame supports and longitudinally moveable between a first, extended position and a second, retracted position, said carriage assembly including (1) a pair of horizontal, longitudinally-extended, laterally spaced-apart side rails;

(2) a carriage base that extends between, and joins, said side rails;

(3) a straight, longitudinally-extended, fixed track attached to, and extending along an entire lower surface of, each of the side rails;

(4) a pliable track aligned and continuous with each said fixed track and extending rearwardly and downwardly thereof;

(5) a plurality of transversely elongated, rectangular slats extending laterally between, and attached to, the pliable tracks; and (6) a laterally-disposed header that joins front portions of the side rails;

(b) carriage assembly support means laterally disposable between, and attachable to, said frame supports, for supporting the carriage assembly and permitting longitudinal movements thereof, said means including (1) a horizontal, rectangular support panel disposable between, and joinable to, the frame supports; and (2) a pair of longitudinally-extended, laterally spaced-apart channels mounted on an upper surface of the support panel, said channels being adapted to receive and retain the fixed and pliable tracks in sliding engagement, each of said channels having rear portions that extend rearwardly and downwardly from the support panel for receiving and retaining the pliable tracks in sliding engagement; and (c) manual means attached to the carriage assembly support means for reversibly locking the carriage assembly in any one of a plurality of longitudinally spaced-apart positions; wherein the seat cushion may rest upon said carriage assembly and be longitudinally movable therewith.

2. The apparatus of claim 1, wherein each of the channels has a U-shaped lateral cross-section and each of the fixed and pliable tracks has an I-shaped, lateral cross-section.

3. The apparatus of claim 2, wherein each of the pliable tracks includes a longitudinally-disposed plurality of alternating upper and lower links, and wherein adjacent upper and lower links are hingedly connected to each other so as to permit vertical rotation of each link with respect to links adjacent to said link.

4. The apparatus of claim 3, wherein each of the upper links has a first, laterally-disposed, downturned, rolled edge, and a second oppositely-directed, laterally-disposed, downturned, rolled edge, each of the lower links has a first, laterally-disposed, upturned, first rolled edge and an oppositely-directed, laterally-disposed, upturned, second rolled edge slightly larger than, and partially surrounding, the first and second rolled edges of adjacent upper links, the upper links have flat upper surfaces, and the lower links have downward projections adapted for retention within, and sliding engagement with, a channel; and further comprising a hinge pin inserted through each of the first and second rolled edges of the upper links.

5. The apparatus of claim 1, 2, 3, or 4, wherein the header has a bale access opening and the manual means attached to the carriage assembly support means for reversibly locking the carriage assembly in any one of a plurality of longitudinally spaced-apart positions includes:

a bale having a pair of laterally spaced-apart, longitudinally-directed stringers joined at a forward end thereof by a laterally disposed bight portion, each of said stringers having a straight, front portion, disposed adjacent one of each of said side rails, a straight rear portion that is vertically displaced with respect to said front portion and that terminates in an upturned hook end, and a pivot arm joining said front portion to said rear portion;

means attached to the side rails for pivoting said pivot arms about a horizontal, lateral axis;

a handle that is manually accessible through said opening and attached to said bight portion;

a spring disposed adjacent said opening for urging the bight portion downward; and detent means attached to the support panel for receiving and retaining the upturned hook ends of the bale in any of a plurality of longitudinally-separated positions.

6. The apparatus of claim 5, wherein the chair further includes a laterally disposed, rear wall that joins rear portions of the frame supports, and wherein a slot is interposed between said rear wall and the seat back, said slot being adapted to allow longitudinal movements of the carriage assembly and seat cushion therethrough.

7. A chair with adjustable seat cushion, comprising:

(a) a pair of spaced-apart, vertical frame supports;

(b) a seat back laterally disposed between, and extending above, rear portions of said frame supports;

(c) a flexible seat cushion;

(d) a carriage assembly laterally disposed between said frame supports and longitudinally movable between a first, extended position and a second, retracted position, said carriage assembly including (1) a pair of horizontal, longitudinally-extended, laterally spaced-apart side rails;

(2) a carriage base that extends between, and joins, said side rails;

(3) a straight, longitudinally-extended, fixed track attached to, and extending along an entire lower surface of, each of the side rails;

(4) a pliable track longitudinally aligned and continuous with each said fixed track and extending rearwardly and downwardly thereof;

(5) a plurality of transversely elongated slats extending laterally between, and attached to, the pliable tracks; and (6) a laterally-disposed header that joins front portions of the side rails, said header having a bale access opening;

(e) carriage assembly support means laterally disposed between, and attached to, said frame supports, for supporting the carriage assembly and permitting longitudinal movements thereof, said support means including (1) a horizontal, rectangular support panel disposed between, and joining, the frame supports;

(2) a pair of longitudinally-extended, laterally spaced-apart channels mounted on an upper surface of the support panel, said channels being adapted to receive and retain the fixed and pliable tracks in sliding engagement, each of said channels having rear portions that extend rearwardly and downwardly from the support panel for receiving and retaining the pliable tracks in sliding engagement; and (f) manual means attached to the carriage assembly support means for reversibly locking the carriage assembly in any one of a plurality of longitudinally spaced-apart positions, said manual means including (1) a bale having a pair of laterally spaced-apart, longitudinally-directed stringers joined at a forward end thereof by a laterally disposed bight portion, each of said stringers having a straight, front portion, disposed adjacent one of each said side rails, a straight rear portion that is vertically displaced with respect to said front portion and that terminates in an upturned hook end, and a pivot arm joining said front portion to said rear portion;

(2) means attached to the side rails for pivoting said pivot arms about a horizontal, lateral axis;

(3) a handle that is manually accessible through said opening and attached to said bight portion;

(4) a spring disposed adjacent said opening for urging the bight portion downward; and (5) detent means attached to the support panel for receiving and retaining the upturned hook ends of the bale in any of a plurality of longitudinally-separated positions; wherein the seat cushion rests upon said carriage assembly and is longitudinally movable therewith.

* * * * *